US005228162A

United States Patent [19]

Wu

[11] Patent Number: 5,228,162

[45] Date of Patent: Jul. 20, 1993

[54] TRANSMISSION AND BALANCING MECHANISM FOR THE WORKPIECE SUPPORTING ARM OF A STITCHING MACHINE

[76] Inventors: Kun-Lien Wu; Kun-nan Yang, both of No. 20, Alley 105, Lane 514, Jon Jen Rd., Hsin Chuang, Taipei, Taiwan

[21] Appl. No.: 842,501

[22] Filed: Feb. 27, 1992

[51] Int. Cl.[5] ..... D05B 75/00; A43D 43/00

[52] U.S. Cl. ..... 12/32; 112/258

[58] Field of Search ..... 12/32, 123; 112/258, 112/260

[56] References Cited

U.S. PATENT DOCUMENTS

| | | | |
|---|---|---|---|
| 1,645,872 | 10/1927 | Roger | 112/28 X |
| 2,179,770 | 11/1939 | Wieck | 112/260 |
| 2,623,486 | 12/1952 | Scheiwiller | 112/258 X |
| 3,058,439 | 10/1962 | Fitzgerald et al. | 112/258 |
| 4,375,787 | 3/1983 | Brutti | 112/28 |

*Primary Examiner*—Steven M. Meyers
*Assistant Examiner*—Ted Kavanaugh
*Attorney, Agent, or Firm*—Bacon & Thomas

[57] ABSTRACT

For controlling the movement of the rotating shuttle and the feed plate and the positioning of the workpiece supporting arm of a stitching machine, a transmission and balancing mechanism comprised of an arm body unit which has one end pivoted to the machine body of a stitching machine and an opposite end coupled with a stitching last and attached with a front cap for supporting a stitching workpiece, a transmission unit fastened inside the arm body unit to alternatively rotate a rotating shuttle back and forth through a belt transmission, an oscillating unit fastened in the arm body unit to alternatively rotate a feed plate holder back and forth permitting a feed plate to be constantly aligned with the needle bar, and a balancing unit which comprises a counter weight coupled to a cam shaft to balance the movement of the arm body unit.

4 Claims, 5 Drawing Sheets

TRANSMISSION AND BALANCING MECHANISM FOR THE WORKPIECE SUPPORTING ARM OF A STITCHING MACHINE

BACKGROUND OF THE INVENTION

The present invention relates to stitching machines. More particularly, the present invention relates to a transmission and balancing mechanism for controlling the movement of the rotating shuttle and the positioning of the workpiece supporting arm of a stitching machine efficiently.

In a stitching machine for use in the industry of shoe making, a movable workpiece supporting arm is generally provided for supporting a workpiece so that a continuous stitching can be made on the workpiece by continuously adjusting the position of the supporting arm on the machine body of the stitching machine. In this structure of stitching machine, as shown in FIG. 1, the reciprocating movement of the rotating shuttle is controlled by a transmission shaft through several bevel gears. These bevel gears make the process of assembly complicated and produce high noise during the operation of the stitching machine. Further, because the bevel gear, which is disposed adjacent to the rotating shuttle in the stitching last of the workpiece supporting arm, has fine teeth, it may be damaged easily while the needle bar is jammed in a workpiece.

SUMMARY OF THE INVENTION

The present invention has been accomplished to eliminate the aforesaid problems. It is therefore an object of the present invention to provide a transmission and balancing mechanism for the workpiece supporting arm of a stitching machine, which produces low noise during stitching operation. It is another object of the present invention to provide a transmission and balancing mechanism for the workpiece supporting arm of a stitching machine, which has means to balance the workpiece supporting arm. It is still another object of the present invention to provide a transmission and balancing mechanism for the workpiece supporting arm of a stitching machine, which is durable in use.

To achieve the aforesaid and other objects, there is provided a transmission and balancing mechanism for controlling the reciprocating movement of the rotating shuttle and the feed plate and the positioning of the workpiece supporting arm of a stitching machine, which is generally comprised of an arm body unit which has one end pivoted to a bearing seat inside the machine body of a stitching machine by a bearing and an opposite end coupled with a stitching last and attached with a front cap for supporting a stitching workpiece, a transmission unit fastened inside the arm body unit to alternatively rotate the rotating shuttle of the stitching machine back and forth through a belt transmission, an oscillating unit fastened in the arm body unit to alternatively rotate a feed plate holder back and forth permitting the feed plate on the feed plate holder to be constantly aligned with the needle bar, and a balancing unit which comprises a counter weight coupled to a cam shaft to balance the movement of the arm body unit. There is also provided a connecting rod connected between the bottom edge of the arm body unit and a bearing block on a shaft of the balancing unit. By means of the support of the connecting rod, any external pressure at the stitching last of the arm body unit will be uniformly distributed through the base thereof.

DETAILED DESCRIPTION OF THE PREFERRED EMBODIMENT

Figure 1:
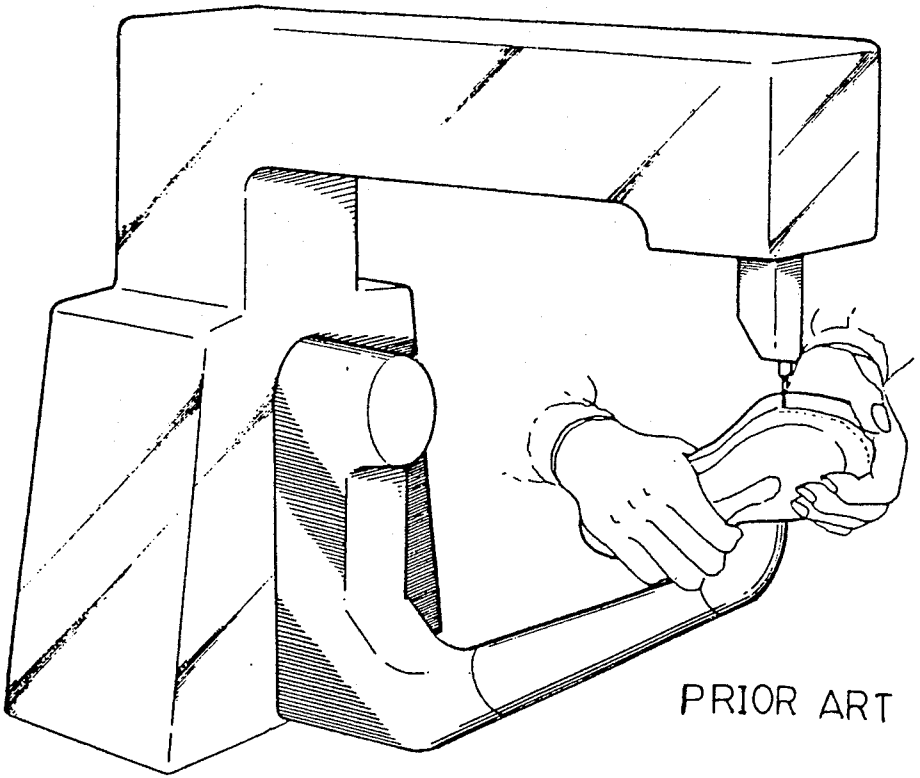
PRIOR ART FIG. 1
FIG. 1 is an elevational view of a prior art stitching machine.
Figure 2:
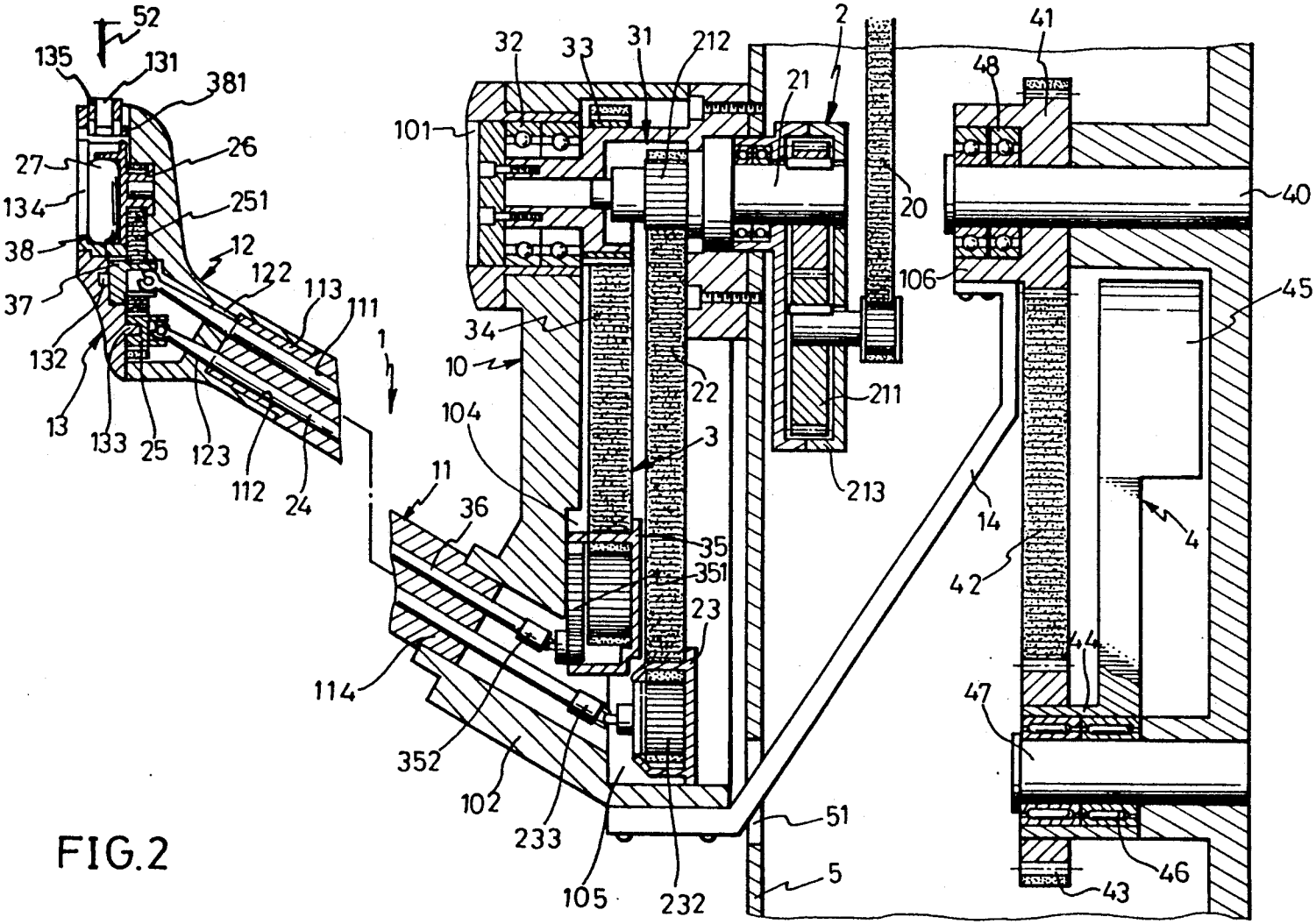
FIG. 2 is a sectional assembly view of the preferred embodiment of the transmission and balancing mechanism of the present invention.
Figure 5:
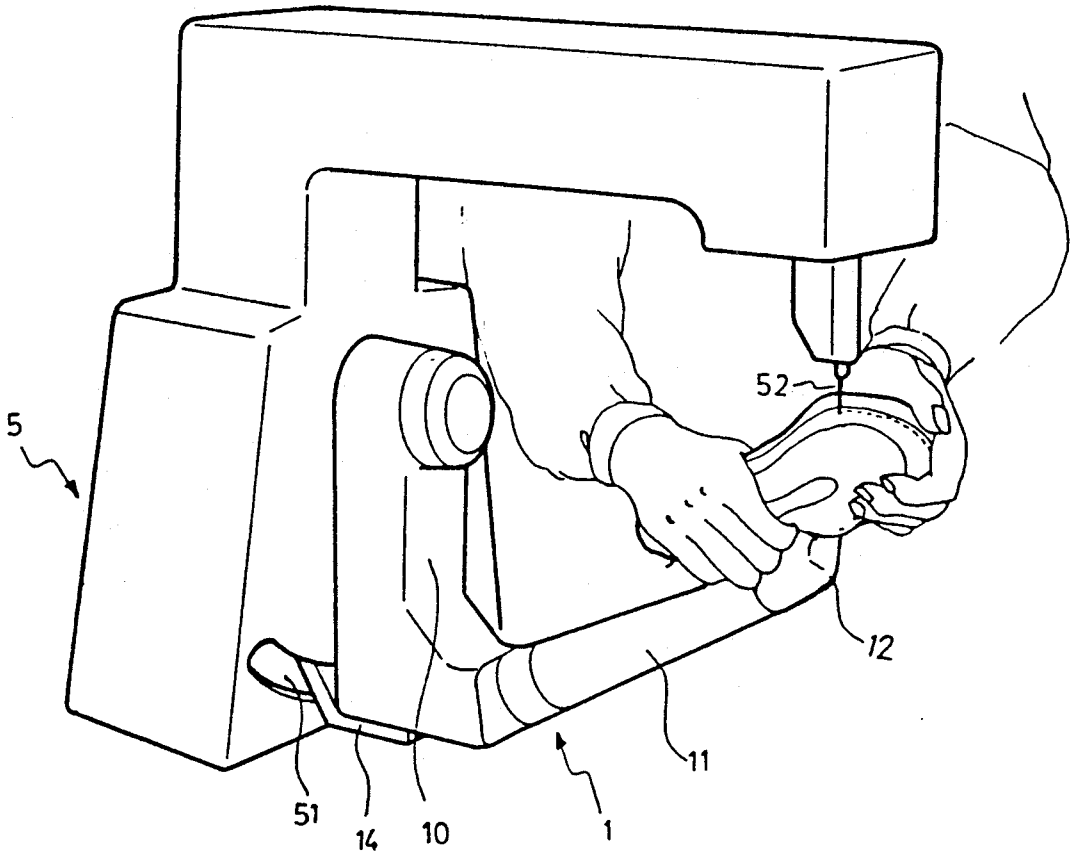
FIG. 5 is an elevational view of a stitching machine constructed according to the present invention.

Turning now to the annexed drawings in detail and referring first to FIGS. 2 and 5, a transmission and balancing mechanism in accordance with the present invention, which is mounted on the machine base 5 of a stitching machine, is generally comprised of an arm body unit 1, a transmission unit 2, an oscillating unit 3 and a balancing unit 4.

Figure 3:
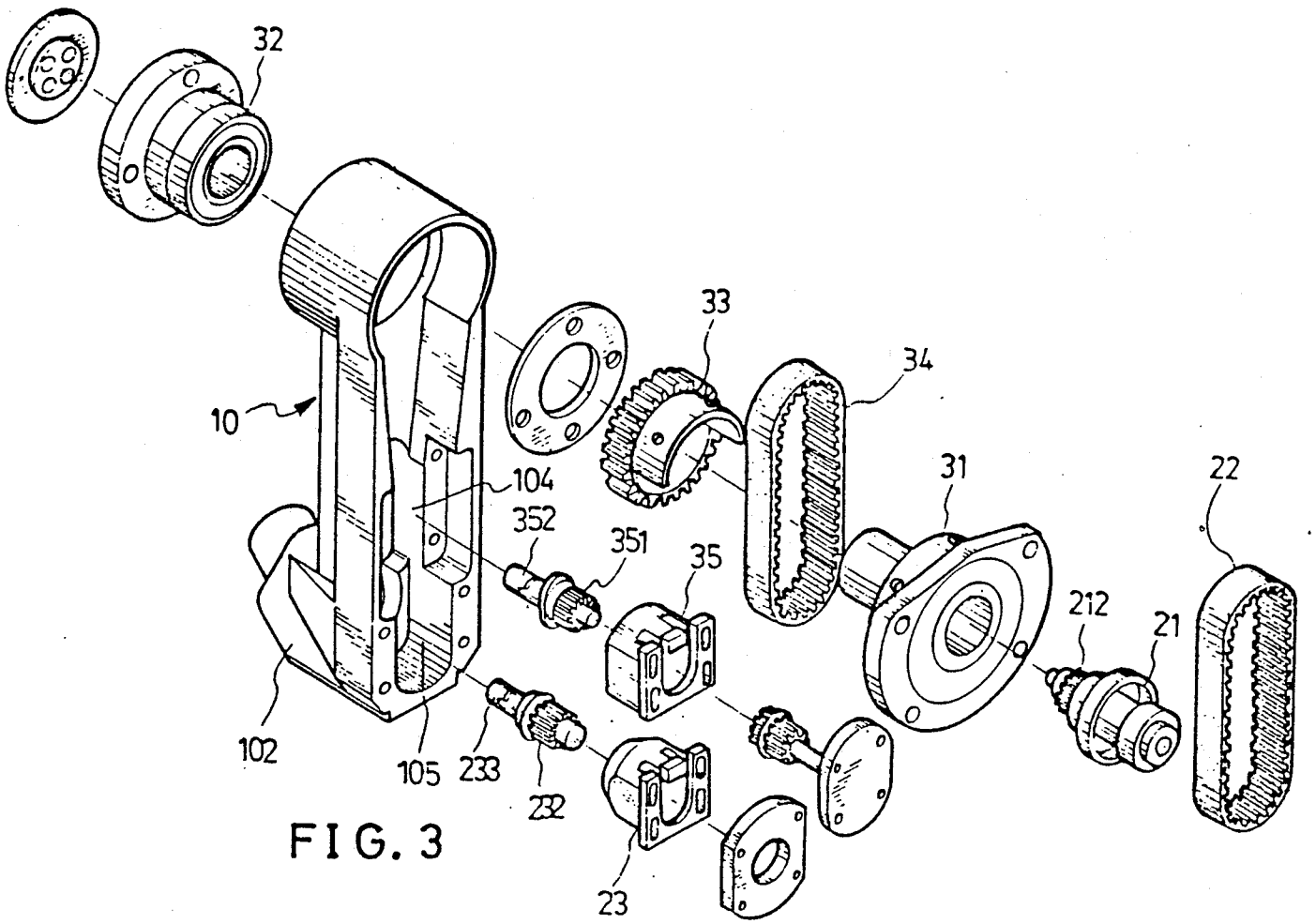
FIG. 3 is an exploded view of the transmission unit according to the present invention.
Figure 4:
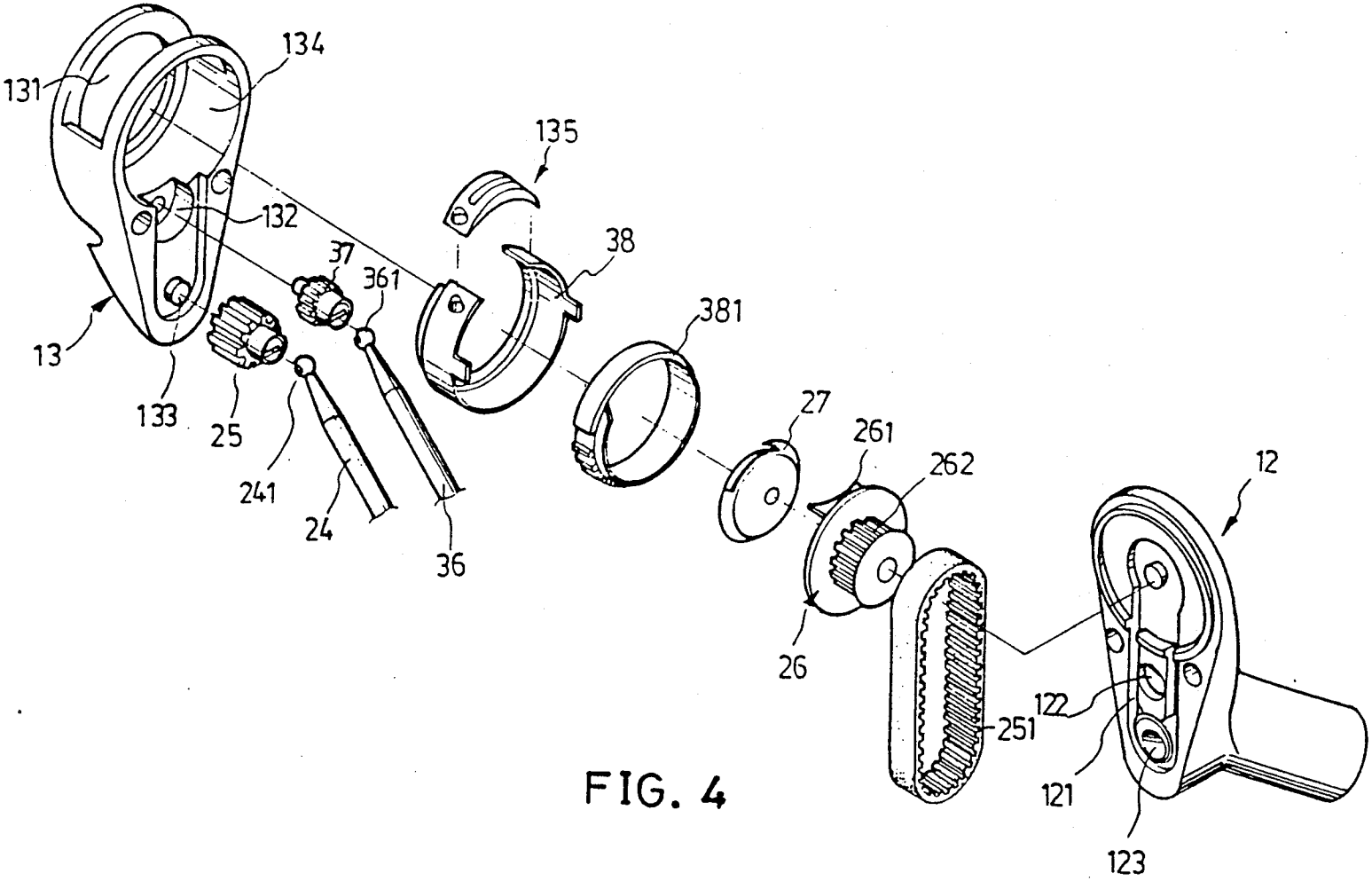
FIG. 4 is an exploded view of the balancing unit according to the present invention.

Referring to FIGS. 3 and 4 and seeing FIGS. 2 and 5 again, the arm body unit 1 is comprised of a base 10 pivoted to the machine base 5, an elongated arm body 11 connected to the base 10, a stitching last 12 supported on the arm body 11, and a front cap 13 coupled to the stitching last 12, wherein the base 10 is made in an elongated shape having a bearing mounting hole 101 at one end pivoted to the machine base 5 by a bearing (this will be detailed further), a bevel hole 102 at an opposite end, and a first chamber 104 and a second chamber 105 defined between the bearing mounting hole 101 and the bevel hole 102; the arm body 11 comprises an upper hole 111 and a lower hole 112 through the longitudinal axis thereof, a first contracted portion 113 at one end, and a second contracted portion 114 at an opposite end inserted in the bevel hole 102 of the base 10; the stitching last 12 is fastened in the first contracted portion 113 of the base, and comprises two axle holes, namely, a first axle hole 122 and a second axle hole 123, and an endless groove 121 on the front face thereof; the front cap 13 is made in a shape fitting the stitching last 12, and comprises a gear chamber 132 and a stub axle 133 on its connecting face to the stitching last 12, a round hole 134 above the gear chamber 132 for holding a rotating shuttle, and an opening 131 on the top edge thereof for passing the needle bar. The bottom end of the base 10 of the arm body unit 1 is further connected by a connecting rod 14 to a bearing block 106 inside the machine base 5.

The transmission unit comprises a central shaft 21 driven to rotate by a driving belt 20 via a speed changing gear set 211, a drive gear 212 mounted on the central shaft 21, a gear holder 23 fastened inside the second chamber 105 to hold a driven gear 232, a toothed belt 22 mounted around the drive gear 212 and the driven gear 232, a universal joint 233 having one end connected to the gear shaft of the driven gear 232, a lower transmission shaft 24 having one end connected to the opposite end of the universal joint 233 and an opposite end formed into a spherical chuck 241, a reversible transmission gear 25 fastened inside the stitching last 12 and driven to rotate on the stub axle 133 of the front cap 13 by the spherical chuck 241 of the lower transmission shaft 24, a driving belt 251 mounted on the reversible transmission gear 25 and retained in the endless groove 121 to drive an actuating plate 26, and a rotating shuttle 27 driven by the actuating plate 26 to alternatively rotate back and forth. The actuating plate has a gear 262 at one side coupled to the reversible transmission gear 25 by the driving belt 251, and a retaining portion 261 at an opposite side for moving the rotating shuttle 27. Rotating the central shaft 21 causes the actuating plate 26 to synchronously rotate the shuttle 27, by means of the transmission of the toothed belt 22, the gear holder 23, the lower transmission shaft 24 and the reversible transmission gear 25.

Referring to FIGS. 2, 3 and 4 again, the oscillating unit 3 is to keep the feed plate 135 in line with the needle bar 52 during the movement of the arm body unit 1, so as stitching operation can be smoothly performed. As illustrated, the oscillating unit 3 comprises a seat 31 movably fastened in the bearing mounting hole 101 by a bearing 32, a driving gear 33 mounted on the seat 31 concentric to the central shaft 21 to drive a driven gear 351 in a gear holder 35 through a tooted belt 34, an upper transmission shaft 36 having one end connected to the driven gear 351 by a universal joint 352 and an opposite end inserted through the upper hole 111 of the arm body 11 and formed into a spherical chuck 361 to drive a reversible transmission gear 37, a toothed ring 381 meshed with the reversible transmission gear 37 and protected by a feed plate holder 38 inside the round hole 134.

Referring to FIG. 2 again, the balancing unit 4 comprises an upper shaft 40 (in line with the central shaft 21) coupled with an upper gear 41 by a bearing 48, a lower shaft 47 coupled with a lower gear 43 by a bearing 46, a driving belt 42 mounted between the upper and lower gears 41, 43, and a cam shaft 44 mounted the lower shaft 47 between the lower gear 43 and coupled with a counter weight 45. Moving the arm body unit 1 forwards (backwards) causes the counter weight 45 to move backwards (forwards), and therefore, the arm body unit 1 is constantly maintained at a balanced position.

Further, the positions of the gear holders 23, 35 in the second and first chambers 105, 104 can be respectively adjusted, so that the tensions of the belts 22, 34 can be relatively adjusted for non-noise transmission. The spherical chuck 241 or 361 of the transmission shaft 24 or 36 is secured to a cross bar in a hole on the gear shaft of the reversible transmission gear 25 or 37, and therefore, rotating the transmission shaft 24 or 36 in either direction causes the reversible transmission gear 25 or 37 to rotate. The arrangement of the aforesaid connecting rod 14 is to reduce the problem of stress concentration at the bevel hole 102 and the central shaft 21. While stitching, the pressure applied at the stitching last 12 and the front cap 13 will be partly transmitted through the connecting rod 14 to the upper gear 41 (because the connecting rod 14 has one end connected to the bottom edge of the base 10 and an opposite end inserted through a curved groove 51 on the machine base 5 and coupled to the gear block 106 of the upper gear 41).

What is claimed is:

1. For controlling the movement of a rotating shuttle and feed plate and the positioning of a workpiece supporting arm of a stitching machine, a transmission and balancing mechanism comprised of an arm body unit, a transmission unit, an oscillating unit, and a balancing unit, and characterized in that:

said arm body unit comprises a base pivoted to the machine body of the stitching machine, an arm body, a stitching last connected to said base by said arm body, and a front cap attached to said stitching last, said base having a bearing hole at one end pivoted to a bearing seat on said machine body by a bearing, a bevel hole at an opposite end, a first chamber and a second chamber between said bearing hole and said bevel hole, said arm body comprising an upper hole and a lower hole through a longitudinal axis thereof;

said transmission unit comprises a central shaft inserted through a hole on said bearing seat, a first drive gear fixedly mounted on said central shaft, a first gear holder adjustably fastened inside said second chamber to hold a first driven gear, a first toothed driving belt mounted around said first drive gear and said first driven gear, a lower transmission shaft having one end connected to said first driven gear by a universal joint and an opposite end inserted through said lower hole and formed into a first spherical chuck, a first reversible transmission gear coupled to said first spherical chuck, a second toothed driving belt mounted on said first reversible transmission gear to drive the rotating shuttle via an actuating plate;

said oscillating unit comprises a second drive gear mounted on said bearing seat concentric to said central shaft to drive a second driven gear in a second gear holder through a third toothed driving belt, an upper transmission shaft having one end connected to said second driven gear by a universal joint and an opposite end inserted through said upper hole and formed into a second spherical chuck to drive a second reversible transmission gear, a toothed ring meshed with said second reversible transmission gear, a circular feed plate holder disposed around said toothed ring to hold the feed plate permitting a needle hole on said feed plate to be constantly aligned with the needle bar of said stitching machine; and said balancing unit comprises an upper shaft coupled with an upper gear, a lower shaft coupled with a lower gear, a fourth toothed driving belt mounted on said upper and lower gears, and a cam shaft mounted said lower shaft and coupled with a counter weight, permitting said counter weight to be moved in a reverse direction against said arm body unit upon moving of said arm body.

2. The transmission and balancing mechanism of claim 1, wherein said bevel hole of said base of said arm body unit has a bottom edge connected to a bearing block on said upper shaft by a connecting rod permitting said arm body unit to be supported by said connecting rod.

3. The transmission and balancing mechanism of claim 1, wherein said stitching last has an endless groove for holding said second toothed driving belt; said front cap has a curved opening on a top edge thereof for sliding said feed plate.

4. The transmission and balancing mechanism of claim 1, wherein said first and second reversible gears each has a cross bar on a hollow gear shaft thereof for coupling said first or second spherical chuck.

* * * * *